US010378144B2

(12) United States Patent
Hawley et al.

(10) Patent No.: US 10,378,144 B2
(45) Date of Patent: Aug. 13, 2019

(54) HANDHELD ROLLER DEVICE FOR SEWING

(71) Applicant: CLOVER MFG. CO., LTD., Osaka-shi, Osaka (JP)

(72) Inventors: Joan Hawley, Westerville, OH (US); Yasuhiro Fujiwara, Osaka (JP); Yui Teramoto, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 0 days.

(21) Appl. No.: 15/699,212

(22) Filed: Sep. 8, 2017

(65) Prior Publication Data

US 2018/0073189 A1 Mar. 15, 2018

(30) Foreign Application Priority Data

Sep. 15, 2016 (JP) ..... 2016-180319

(51) Int. Cl.
*D06F 71/30* (2006.01)

(52) U.S. Cl.
CPC ..... *D06F 71/30* (2013.01)

(58) Field of Classification Search
CPC ..... D06F 71/30; D06F 71/32; D06F 71/326; D06F 71/36; D06F 71/40; D06F 85/00; A61F 2007/0087; A45D 40/26; A45D 34/04; A45D 34/041; B44B 5/00; B44B 5/0004; B44B 5/0009; B44B 5/0047; B44B 5/0052; B05C 17/02; B05C 17/035; B05C 17/0205; B05C 17/0215; B05C 17/0217; B05C 17/04; B29C 59/04; B29C 59/043; B29C 59/046
USPC ..... D4/122; D9/726
See application file for complete search history.

(56) References Cited

U.S. PATENT DOCUMENTS 2,766,473 A * 10/1956 Thackara ..... B05C 17/02 15/230.11
3,588,264 A * 6/1971 Mallindine ..... B05C 17/0217 15/230.11
3,742,882 A * 7/1973 Wren ..... D05B 35/08 112/217
D306,524 S * 3/1990 Marshall ..... D4/122
5,317,779 A * 6/1994 Hoagland ..... A47L 17/04 15/105

(Continued)

FOREIGN PATENT DOCUMENTS

JP 52-022278 2/1977

*Primary Examiner* — Ismael Izaguirre
(74) *Attorney, Agent, or Firm* — Hamre, Schumann, Mueller & Larson, P.C.

(57) ABSTRACT

A handicraft roller, used for pressing a piece of cloth to put a sharp crease or fold in the fabric, includes an elongated grip with first and second ends spaced from each other in the longitudinal direction of the grip. A rolling member is attached to the first end of the grip so as to be rotatable about a predetermined axis. The rolling member is made up of a constant diameter portion and two decreasing diameter portions flanking the constant diameter portion. The constant diameter portion has an outer diameter that remains constant over a predetermined length of the axis. Each of the decreasing diameter portions has an outer diameter that decreases with increasing distance from the constant diameter portion along the axis.

10 Claims, 7 Drawing Sheets

(56) References Cited

U.S. PATENT DOCUMENTS

| | | | | |
|---|---|---|---|---|
| 5,836,041 | A * | 11/1998 | Kleinpell, II | A47L 1/16 15/236.02 |
| 6,484,341 | B2 * | 11/2002 | Hefti | A21C 3/021 492/13 |
| 6,648,904 | B2 * | 11/2003 | Altshuler | A46B 15/0036 492/46 |
| 8,844,543 | B2 * | 9/2014 | Bickford | A45D 34/041 132/320 |
| D738,698 | S * | 9/2015 | Calman | D8/51 |

* cited by examiner

HANDHELD ROLLER DEVICE FOR SEWING

FIELD

The present disclosure generally relates to a handicraft roller. In particular, the present disclosure relates to a handheld roller device for sewing, used for pressing fabric or the like to put a sharp crease or make a neat fold in the fabric.

BACKGROUND

Conventionally, use may be made of an iron for putting creases in cloth or making folds along seam allowances of fabrics sewn together. Ironing, however, may not be done quickly, due to a certain amount of time taken in waiting for the iron to become sufficiently hot. Also, when fabric is thick, the ironing may leave an unwanted trace in the fabric, for example, along the edge of a folded seam allowance due to a rather large pressing surface of the iron. Further or in the first place, ironing cannot be performed for materials with poor heat resistance such as vinyl.

SUMMARY

According to an aspect of the present disclosure, there is provided a handheld roller device or handicraft roller including: a grip elongated in a first direction and having a first end and a second end that are spaced from each other in the first direction; and a rolling member attached to the first end of the grip and being rotatable about an axis. The rolling member includes a constant diameter portion and a pair of decreasing diameter portions flanking the constant diameter portion. The constant diameter portion has an outer diameter that remains constant along the axis. Each of the decreasing diameter portions has an outer diameter that decreases with increasing distance from the constant diameter portion along the axis.

In an embodiment, the grip may include a front end wall facing the rolling member, a pair of supporting pieces extending from the front end wall in the first direction and rotatably supporting the rolling member, and an extension piece disposed between the supporting pieces in plan and extending from the front end wall in the first direction.

In an embodiment, the extension piece may overlap with a part of the rolling member in plan.

In an embodiment, the grip may include an upper side formed with a first recess located closer to the first end than to the second end.

In an embodiment, the grip may be formed with a second recess located closer to the second end than to the first end, where the second recess is recessed toward the upper side of the grip.

In an embodiment, each of the decreasing diameter portions may be convexly curved as viewed in a direction perpendicular to the axis.

In an embodiment, the dimension of the constant diameter portion along the axis is in a range of ⅙ to ⅓ of the dimension of the rolling member along the axis.

In an embodiment, the dimension of the constant diameter portion along the axis may be in a range of 3 to 5 mm.

In an embodiment, the grip may be made of a resin and formed into as a one-piece member.

In an embodiment, the axis may be perpendicular to the first direction.

In an embodiment, the extension piece may be connected to an upper part of the front end wall.

Further features and advantages of the present disclosure will become apparent from the following detailed description with reference to the accompanying drawings.

DESCRIPTION OF THE PREFERRED EMBODIMENTS

Figure 1:
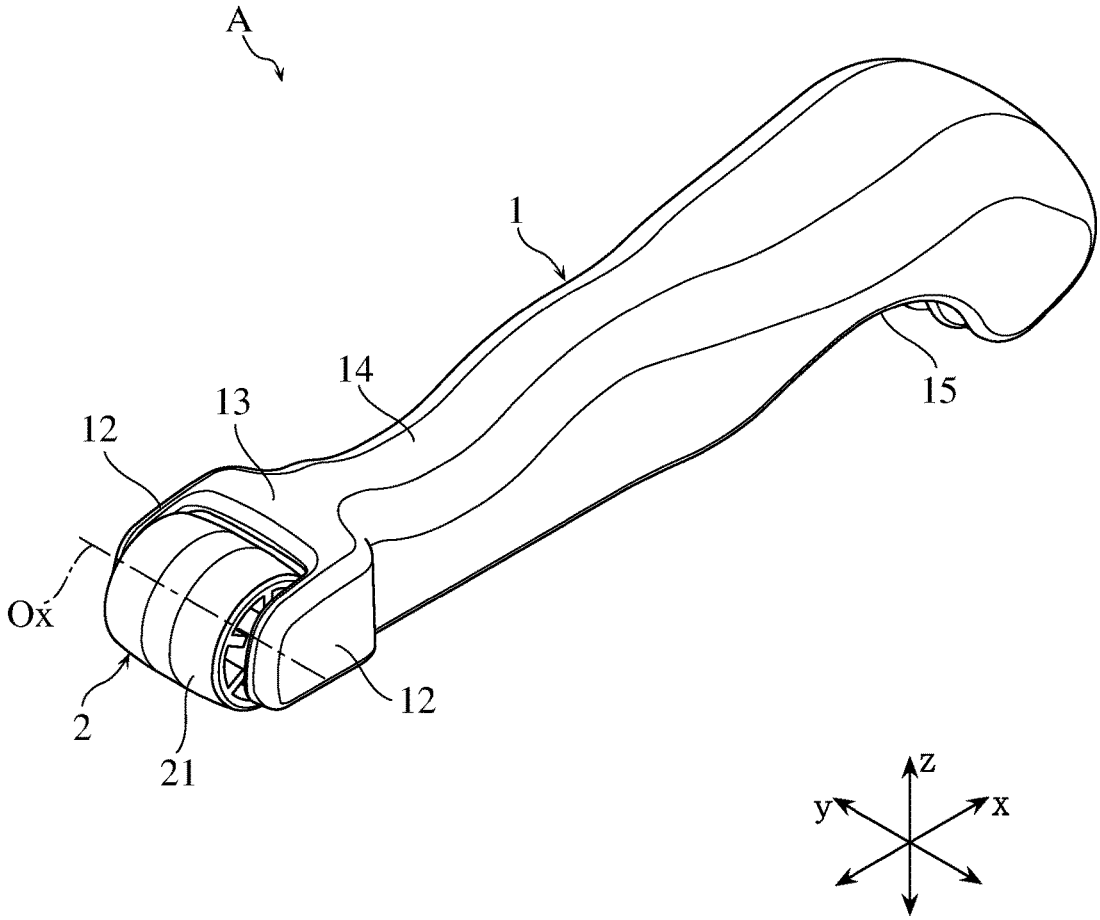
FIG. 1 is a perspective view showing a handicraft roller according to an embodiment the present disclosure.

Preferred embodiments of the present disclosure will be described below with reference to the accompanying drawings.

FIG. 1-7 illustrate a handheld roller device for sewing or handicraft roller according to an embodiment of the present disclosure. As shown in FIGS. 1-5, the handicraft roller A of the present embodiment includes an elongated grip 1 and a rolling presser 2 rotatably attached to an end of the grip 1. Specifically, the rolling presser 2 is attached to one of the longitudinally opposite two ends of the grip 1. In the figures, the longitudinal direction of the grip 1 is depicted as corresponding to direction x. Hereinbelow, the side on which the rolling presser 2 is provided is referred to as "front" side in the direction x. The two directions perpendicular to the direction x and also perpendicular to each other are referred to as direction y and direction z, respectively.

The grip 1 is a portion to be held by a user. The grip 1 as a whole is generally in the form of a bar elongated in the direction x. The grip 1 has a front end wall 11 (see FIG. 2), a pair of supporting pieces 12 for supporting the rolling presser 2, an extension piece 13, a first or upper recess 14 and a second or lower recess 15.

Figure 2:
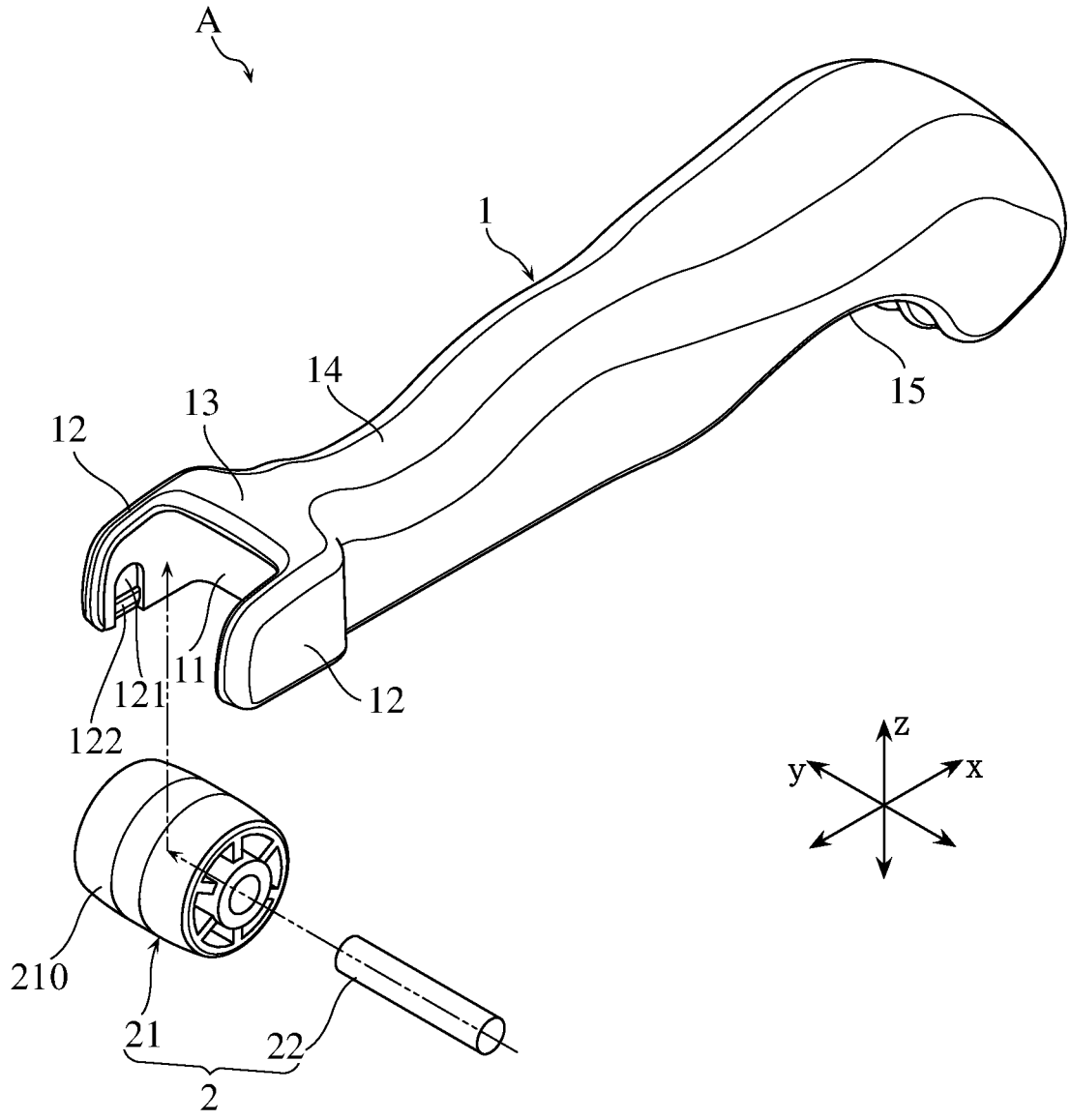
FIG. 2 is an exploded perspective view of the handicraft roller shown in FIG. 1.
Figure 5:
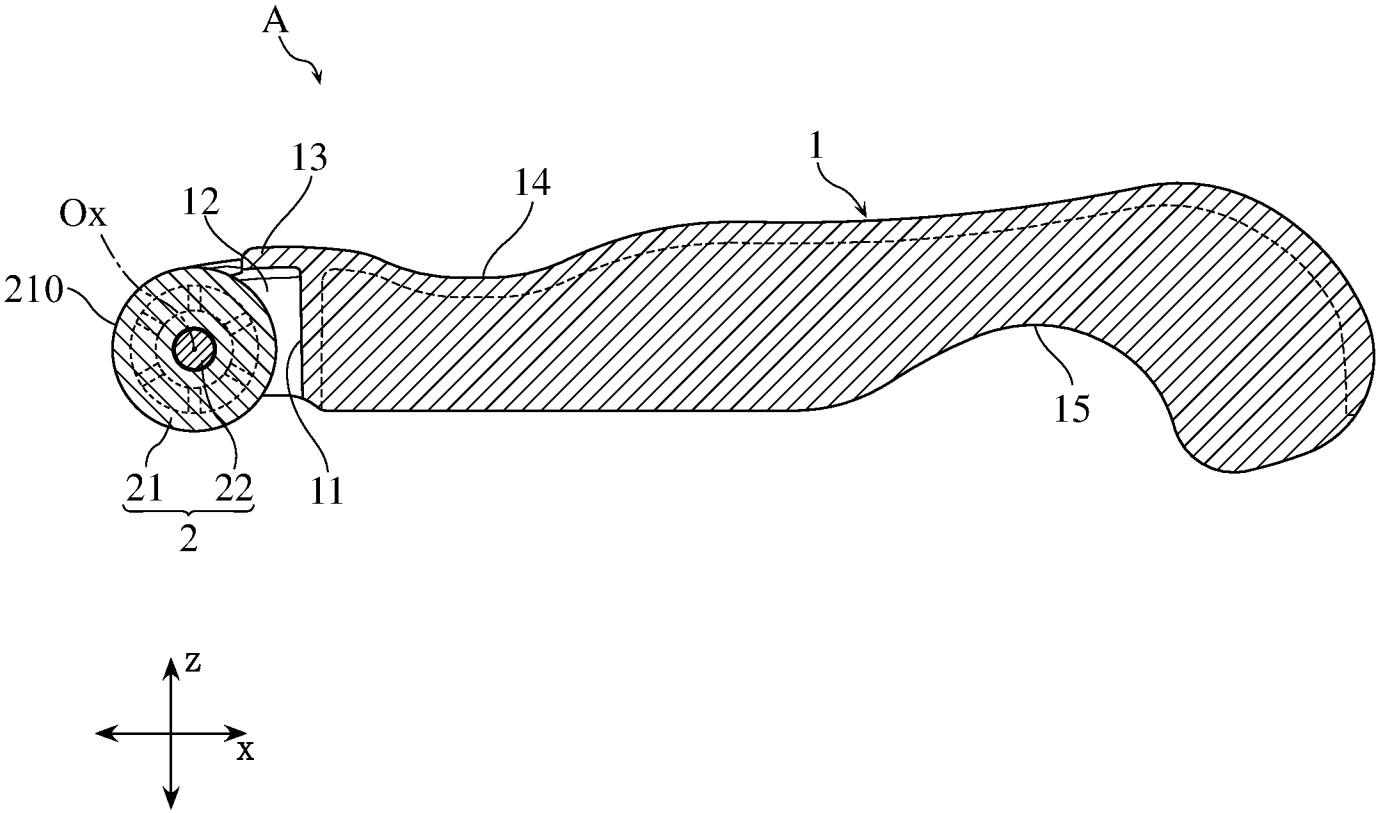
FIG. 5 is a sectional view taken along line V-V in FIG. 3.

As shown in FIG. 2, the front end wall 11 is formed at the front end of the grip 1 and faces the circumferential surface of a rolling member 21 (see also FIG. 5).

The front end wall 11 of the grip 1 has two opposite ends spaced apart from each other in the direction y, and the two supporting pieces 12 extend forward from those opposite ends of the front end wall 11, respectively.

Referring to FIG. 5, the extension piece 13 extends forward from a predetermined portion of the grip 1. In the illustrated example, this portion of the grip 1 corresponds to the uppermost position of the front end wall 11, and the upper surface of the extension piece 13 is connected smoothly (i.e., with no intervening step) to the upper surface of the main body of the grip 1. Further, as understood from FIGS. 3 and 5, the extension piece 13 overlaps with a part of the rolling presser 2 (a part closer to the front end wall 11) as viewed in the direction z or in plan view (FIG. 3) between the two supporting pieces 12. In the illustrated example, referring to FIG. 5, the shortest distance between the front end wall 11 and the rolling presser 2 (more precisely, the outer surface of the rolling member 21) is smaller than the length of the extension piece 13 measured in the direction x.

Figure 4:
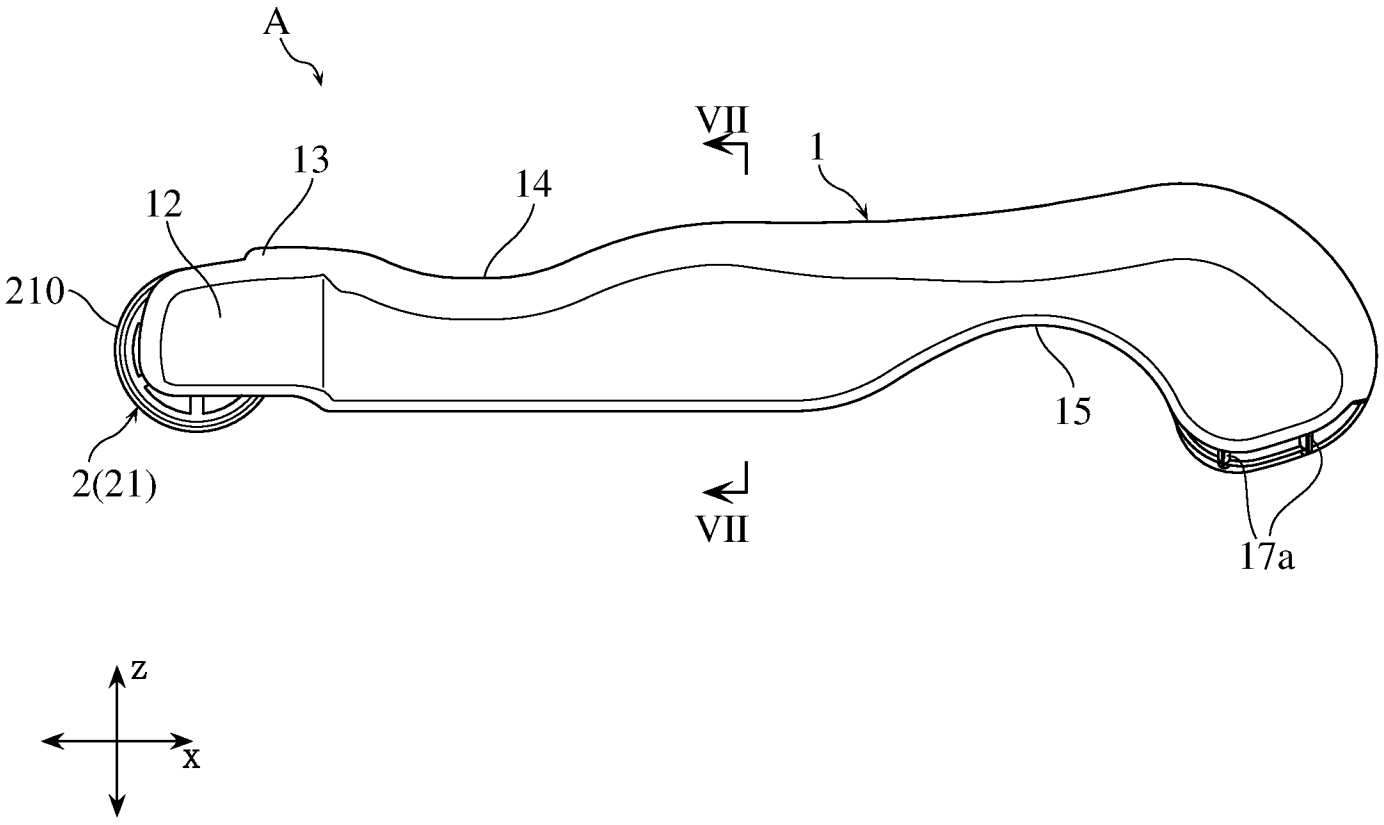
FIG. 4 is a side view of the handicraft roller shown in FIG. 1.
Figure 7:
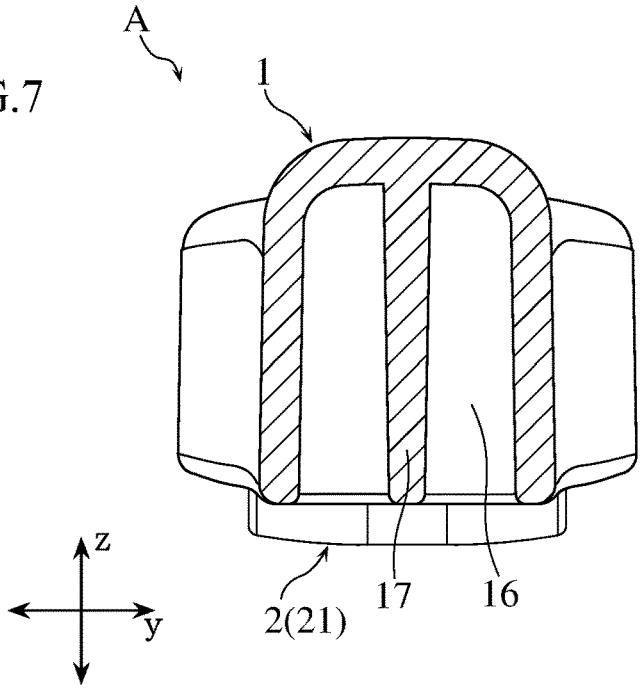
FIG. 7 is an enlarged sectional view taken along line VII-VII in FIG. 4.

As will be understood from FIGS. 2, 4 and 7, in the present embodiment, the grip 1 may be a generally hollow member that is defined by outer wall portions (such as side walls and upper walls, but no bottom wall) and open to below. In the present embodiment, the inner space or the hollow of the grip 1 is provided with a suitable number of ribs for reinforcement of the grip 1. These ribs may include a longitudinal central rib (see reference 17 in FIG. 7) which extends in the direction x, from the base end toward the front end of the grip 1, and auxiliary ribs (shorter ribs) divided into two groups arranged to flank the central rib 17 in crossing contact with the central rib. Some of the auxiliary ribs 17*a* are shown in FIG. 4. As seen from FIG. 7, compartments or sub-spaces 16 are defined by the outer wall portions of the rib 1, the central rib 17 and the auxiliary ribs (not shown in FIG. 7). The grip 1 including the above-mentioned wall portions and ribs may be integrally made of a hard resin (such as Acrylonitrile-Butadiene-Styrene resin, or ABS resin) as a one-piece member.

The first recess 14 is provided on the upper side or upper surface of the grip 1. The first recess 14 is concavely curved toward the inside of the grip 1 in the direction z. The second recess 15 is provided on the lower side of the grip 1. Similarly to the first recess 14, the second recess 15 is concavely curved toward the inside of the grip 1 in the direction z. In other words, the second recess 15 is recessed toward the upper surface of the grip 1. The first recess 14 is positioned closer to the front end wall 11 than is the second recess 15 in the direction x. As shown in FIG. 4, the second recess 15 is closer to the base end of the grip 1 and may generally have a greater curvature than the first recess 14.

As shown in FIGS. 1 and 2, the rolling presser 2 includes a shaft 22, and a rolling member 21 supported rotatably around the shaft 22. The rolling presser 2 is supported at its two ends (spaced in the direction y) by the respective supporting pieces 12 such that its rotation axis Ox is parallel to the direction y. The rolling presser 2 is rotatable about the rotation axis Ox. In this embodiment, without limitation, the shaft 22 is made of a metal. The rolling member 21 may be made of a resin that is relatively hard. In addition, the relatively hard resin may be a resin that ensures proper sliding movement of the rolling member 21 against the fabric, while also ensuring easy release (or peeling) of an adhesive material accidentally stuck to the surface of the rolling member 21. Examples of such a resin include polyacetal resin.

The rolling member 21 has a generally cylindrical shape with a central hole configured to receive the shaft 22. The inner diameter of the rolling member 21 is slightly larger than the outer diameter of the shaft 22. The outer diameter of the rolling member 21 is not entirely constant along the direction y. Specifically, as shown in FIGS. 3 and 6, the rolling member 21 includes a constant diameter region (or portion) 211 and a pair of decreasing diameter regions (or portions) 212 flanking the constant diameter region 211 in the direction y.

The constant diameter region 211 has a constant outer diameter measured at positions along (a predetermined section of) the rotation axis Ox and is provided at a central region of the rolling member 21 in the direction y.

The paired decreasing diameter regions 212 are connected to the opposite ends of the constant diameter region 211, respectively, in the direction y. The outer diameter of each of the decreasing diameter regions 212 decreases as proceeding away (i.e., with increasing distance) from the constant diameter region 211 in the direction y. In this embodiment, the outer surface of each decreasing diameter region 212 is convexly curved as viewed in a direction perpendicular to the rotation axis Ox (e.g., the direction x as depicted in FIG. 6).

Figure 3:
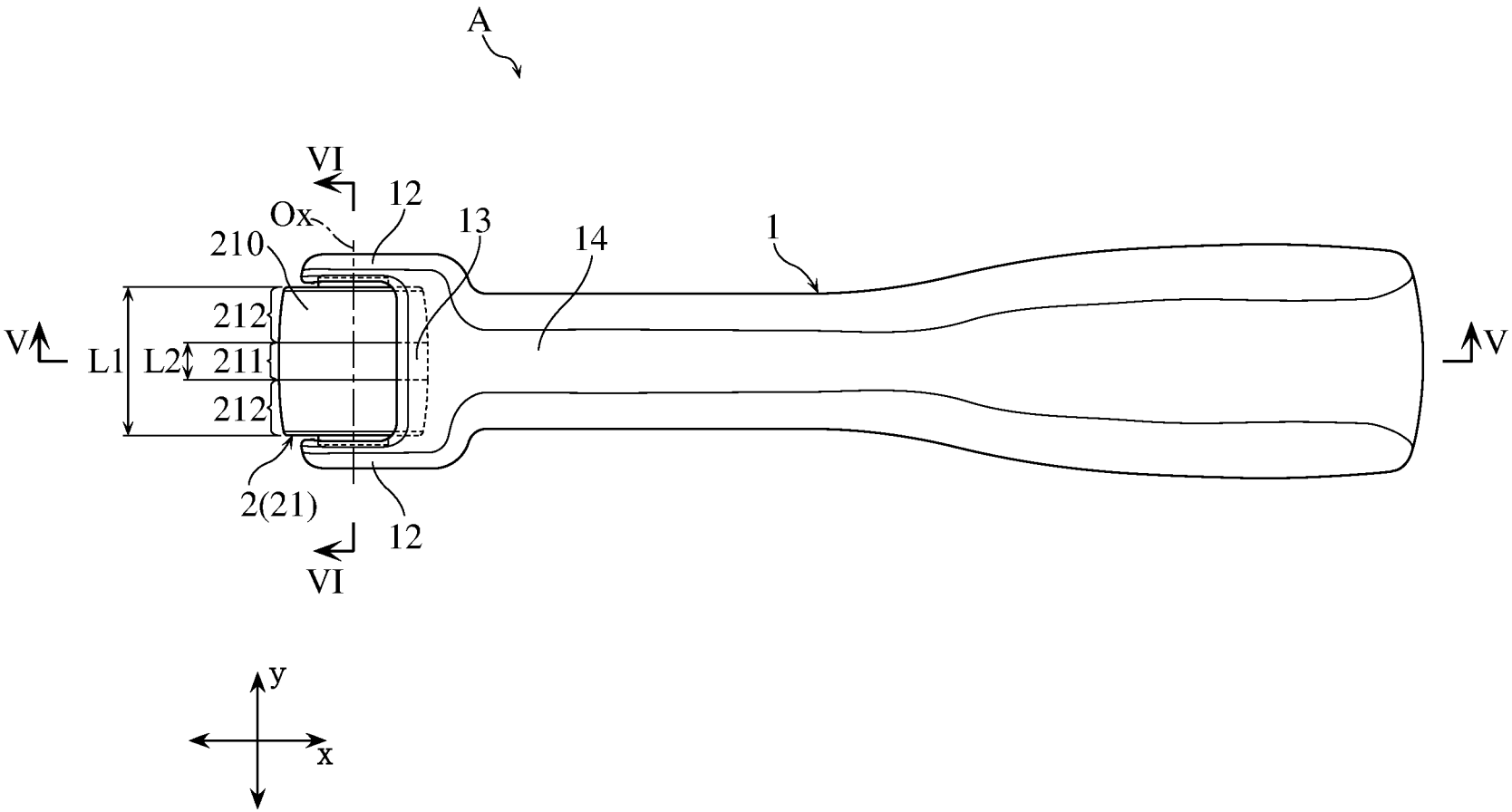
FIG. 3 is a plan view of the handicraft roller shown in FIG. 1.
Figure 6:
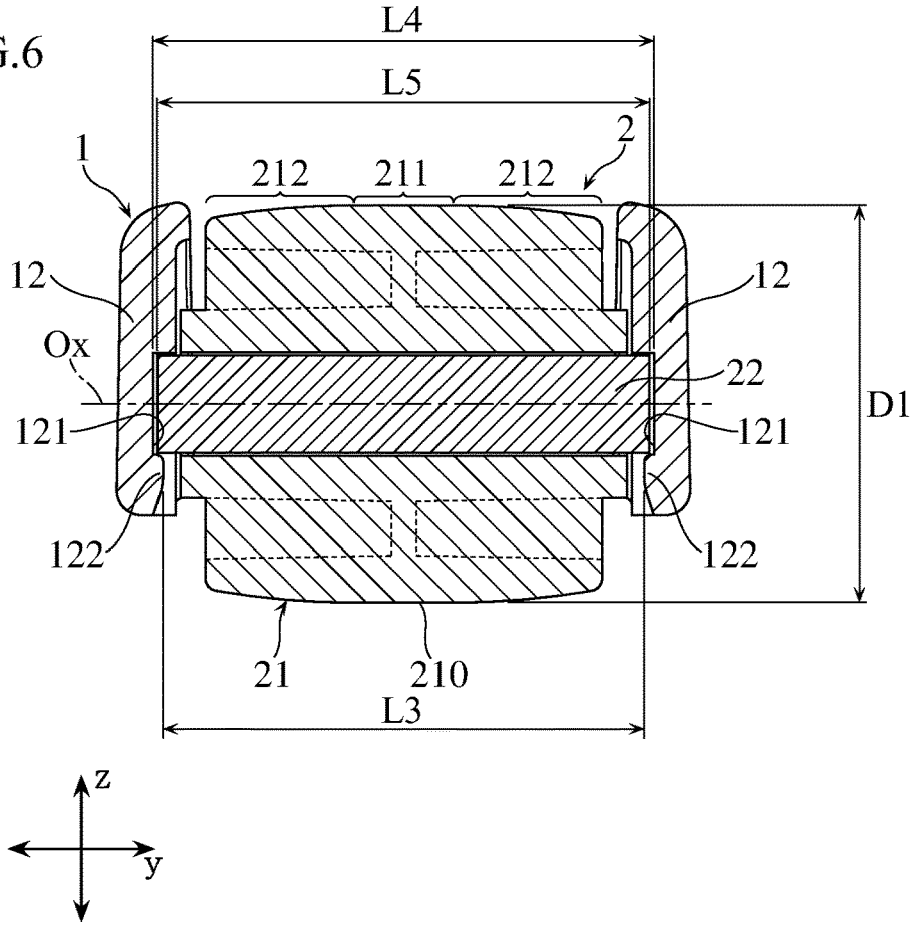
FIG. 6 is an enlarged sectional view taken along line VI-VI in FIG. 3.

Referring to FIGS. 3 and 6, an example of the dimensions of the rolling member 21 (rolling presser 2) is as follows. The dimension L1 of the outer circumferential surface 210 in the direction along the rotation axis Ox may be 15-20 mm, the dimension L2 of the constant diameter region 211 in the direction along the rotation axis Ox may be 3-5 mm, and the outer diameter D1 of the constant diameter region 211 may be 15-20 mm. Further, the ratio of the dimension L2 to the dimension L1 may be in the range of ⅙ to ⅓.

As shown in FIGS. 2 and 6, each of the paired supporting pieces 12 is formed with an engagement groove 121 for receiving a corresponding end of the shaft 22. As shown in FIG. 6, the engagement grooves 121 are formed at respective inner surfaces (mutually facing surfaces) of the paired supporting pieces 12. As shown in FIG. 2 (only one groove 121 shown), each engagement groove 121 extends in the direction z with its upper end closed, where the upper end is curved correspondingly to the curvature of the round surface of the shaft 22, so that the shaft 22 can rotate about the rotation axis Ox in sliding contact with the upper end. At its lower end, the engagement groove 121 is "partially closed (or partially open)" by an engagement projection 122 projecting inward in the direction y. Hence, as shown in FIG. 6, the distance L3 between the paired engagement projections 122 is smaller than the distance L4 between the bottom surfaces of the paired engagement grooves 121. The dimension L5 of the shaft 22 along the rotation axis Ox is larger than the distance L3 and smaller than the distance L4. With these dimensional arrangements, the rolling presser 2 can be attached to the grip 1 in the following manner.

As shown in FIG. 2, to assemble the handicraft roller A, the rolling presser 2 is attached to the grip 1 (precisely, the supporting pieces 12) from below. Specifically, the ends of the shaft 22 are inserted, from below the supporting pieces 12, into the respective engagement grooves 121 through their lower ("partially closed") ends. In this process, due to the dimensional relationship described above, the supporting pieces 12 are pushed away from each other by the shaft 22, while elastically deforming in the direction y, thereby allowing the shaft 22 to pass over the engagement projections 122. Once received in the engagement grooves 121 after passing over the engagement projections 122, the ends of the shaft 22 engage with the respective engagement projections 122 so that the shaft 22 is not to fall out of the grooves 121.

In the illustrated example (see FIG. 6), the maximum vertical length of each engagement groove 121 (stopped below by the upper side of the engagement projection 122) may be substantially the same as the diameter of the shaft 22, whereby there is very little or even no play for the shaft 121 regarding vertical movement once the shaft 22 is fitted into the grooves 121. Alternatively, the maximum vertical length of each engagement groove 121 may be made significantly greater than the diameter of the shaft 22, so that the attached shaft 22 (hence rolling member 21) can vertically shift relative to the supporting pieces 12.

The rolling presser 2 is not limited to the configuration made up of the rolling member 21 and the shaft 22 that are separately provided. Instead, the rolling presser 2 may be a single unit provided by integrally molding a rolling member portion and a shaft portion.

Figure 8:
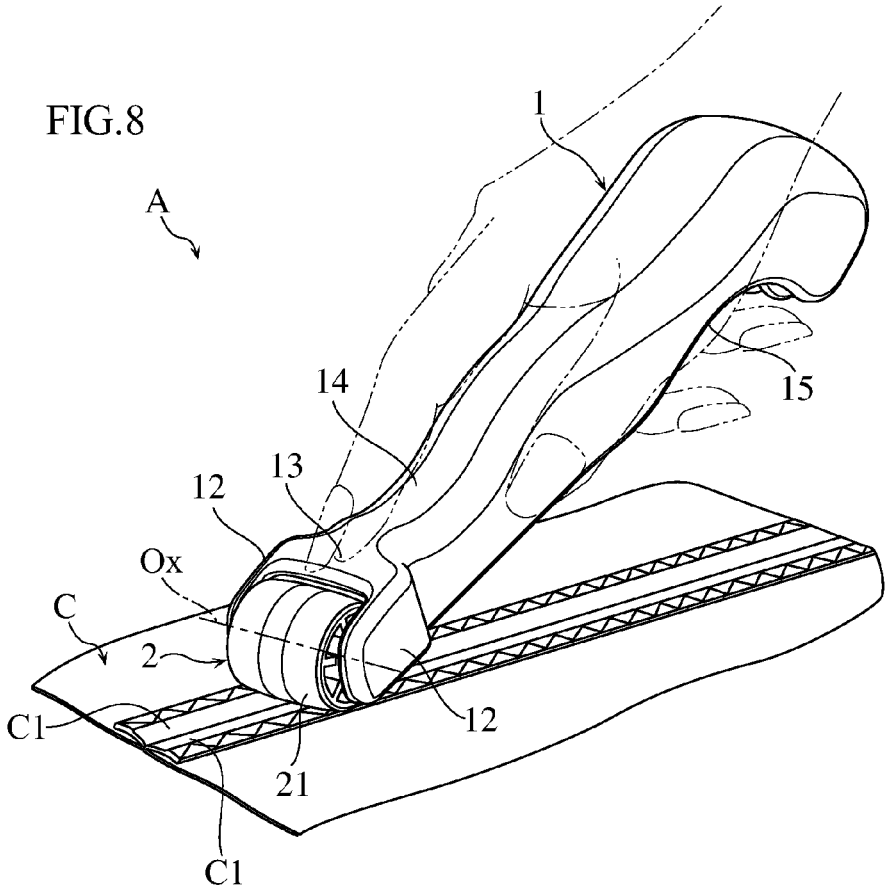
FIG. 8 is a perspective view for explaining how to use the handicraft roller.
Figure 9:
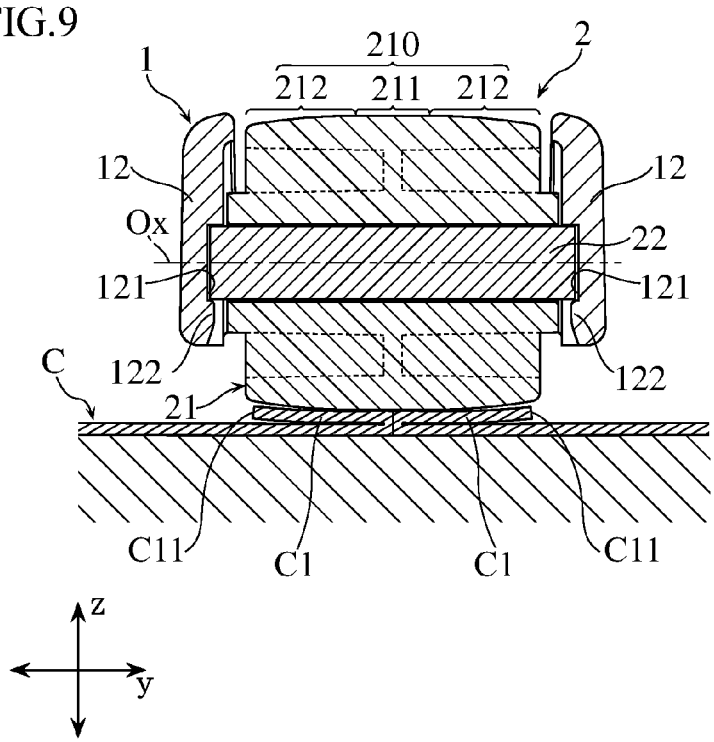
FIG. 9 is a sectional view corresponding to FIG. 6 for explaining how to use the handicraft roller.

Referring to FIGS. 8 and 9, the handicraft roller A may be used in the following manner. The advantages of the handicraft roller A will also be described below.

FIG. 8 illustrates how a fold is made with respect to the open seam allowances C1 of cloth C. FIG. 9 is a cross-sectional view illustrating the fold making operation. As shown in FIG. 8, the user holds the grip 1 (see the phantom line) and moves the rolling presser 2 along the seam allowance C1 while pressing the rolling presser 2 against the cloth C.

As described above, the rolling member 21 has the constant diameter region 211 and the pair of decreasing diameter regions 212. According to this configuration, the relatively narrow constant diameter region 211 can be effectively pressed against the cloth C at the time of making a fold in the cloth C. Thus, it is possible to exert an advantageously great pressing force (per unit area) to the cloth C, which is suitable for making a proper fold in the fabric C.

Further, since the outer diameter of the region 211 is constant, the rolling presser 2 can be linearly moved on the cloth C.

Suppose now that a rolling presser as a whole has a constant outer diameter along the axial direction, unlike the present embodiment. When the seam allowance C1 is pressed by this constant-diameter rolling presser, a trace of the edge C11 of the seam allowance C1 is left in the fabric C. According to the present embodiment, on the other hand, the rolling member 21 has the pair of decreasing diameter regions 212. Hence, as shown in FIG. 9, the edges C11 of the respective seam allowances C1 are not strongly pressed onto the cloth C, thereby avoiding the mark formation of the seam allowance C1 on the fabric C.

In the present embodiment, the grip 1 is provided with the extension piece 13 close to the rolling member 21. With this configuration, as seen from FIG. 8, the user can put his/her index finger on the extension piece 13. In this manner, the user can apply an appropriate pressure on the rolling presser 2 and hence the seam allowance C1. This is advantageous to making a proper fold in the cloth C while also to stabilizing the running of the rolling presser 2 along the seam allowance C1.

In the present embodiment, the first recess 14 is provided near the front end of the grip 1, while the second recess 15 is provided near the base end of the grip 1. With this configuration, as seen from FIG. 8, the user can hold the grip 1, with his/her fingers comfortably fitting or resting in the recesses 14 and 15.

Embodiments of the present disclosure have been described above, though the present disclosure is not limited thereto, and various modifications are possible without departing from the spirit of the disclosure. The configurations of specific parts or elements of the handicraft roller are not limited to the examples described above.

The invention claimed is:

1. A handicraft roller comprising:

a grip elongated in a first direction and having a first end and a second end that are spaced from each other in the first direction; and a rolling member attached to the first end of the grip and being rotatable about an axis, the rolling member including a constant diameter portion and a pair of decreasing diameter portions flanking the constant diameter portion, wherein the constant diameter portion has an outer diameter that remains constant along the axis, and each of the decreasing diameter portions has an outer diameter that decreases with increasing distance from the constant diameter portion along the axis, and wherein the grip comprises:

a front end wall facing the rolling member;

a pair of supporting pieces extending from the front end wall in the first direction and rotatably supporting the rolling member; and an extension piece disposed between the supporting pieces in plan and extending from the front end wall in the first direction.

2. The handicraft roller according to claim 1, wherein the extension piece overlaps with a part of the rolling member in plan.

3. The handicraft roller according to claim 1, wherein the grip includes an upper side formed with a first recess located closer to the first end than to the second end.

4. The handicraft roller according to claim 3, wherein the grip is formed with a second recess located closer to the second end than to the first end, the second recess being recessed toward the upper side of the grip.

5. The handicraft roller according to claim 1, wherein each of the decreasing diameter portions is convexly curved as viewed in a direction perpendicular to the axis.

6. The handicraft roller according to claim 1, wherein a dimension of the constant diameter portion along the axis is in a range of ⅙ to ⅓ of a dimension of the rolling member along the axis.

7. The handicraft roller according to claim 6, wherein the dimension of the constant diameter portion along the axis is in a range of 3 to 5 mm.

8. The handicraft roller according to claim 1, wherein the grip is made of a resin and formed into a one-piece member.

9. The handicraft roller according to claim 1, wherein the axis is perpendicular to the first direction.

10. The handicraft roller according to claim 1, wherein the extension piece is connected to an upper part of the front end wall.

* * * * *